US006193767B1

(12) United States Patent
Arters et al.

(10) Patent No.: US 6,193,767 B1
(45) Date of Patent: Feb. 27, 2001

(54) FUEL ADDITIVES AND FUEL COMPOSITIONS COMPRISING SAID FUEL ADDITIVES

(75) Inventors: David Arters; Daniel T. Daly, both of Solon; Mitchell M. Jackson, Chagrin Falls, all of OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 09/406,881

(22) Filed: Sep. 28, 1999

(51) Int. Cl.[7] ..... C10L 1/18; C10L 1/22
(52) U.S. Cl. ..... 44/412; 44/432; 44/434
(58) Field of Search ..... 44/432, 434, 412

(56) References Cited

U.S. PATENT DOCUMENTS

| | | | | |
|---|---|---|---|---|
| 4,332,595 | | 6/1982 | Herbstman et al. | 44/72 |
| 4,604,103 | * | 8/1986 | Campbell | 44/434 |
| 4,964,879 | * | 10/1990 | Herbstman | 44/434 |
| 5,006,130 | * | 4/1991 | Aiello et al. | 44/432 |
| 5,089,029 | | 2/1992 | Hashimoto et al. | 44/432 |
| 5,112,364 | * | 5/1992 | Rath et al. | 44/434 |
| 5,196,035 | * | 3/1993 | Johnson | 44/432 |
| 5,264,006 | | 11/1993 | Schilowtitz et al. | 44/434 |
| 5,306,315 | * | 4/1994 | Cherpeck | 44/433 |
| 5,366,517 | * | 11/1994 | Cherpeck | 44/434 |
| 5,660,601 | * | 8/1997 | Oppenlander et al. | 44/434 |
| 5,746,786 | * | 5/1998 | Mueller et al. | 44/432 |
| 5,993,499 | * | 11/1999 | Houser | 44/432 |

* cited by examiner

*Primary Examiner*—Jacqueline V. Howard
(74) *Attorney, Agent, or Firm*—Michael F. Esposito

(57) ABSTRACT

A fuel additive composition comprising at least one amine, whereun said at least one amine contains at least one polyolefin group and at least one polyetheramine. These compositions are useful as fuel additives for reducing intake valve deposits. In addition, these compositions do not contribute to an increase in combustion chamber deposits in port fuel injected internal combustion engines.

33 Claims, No Drawings

FUEL ADDITIVES AND FUEL COMPOSITIONS COMPRISING SAID FUEL ADDITIVES

BACKGROUND OF THE INVENTION

The present invention relates to novel fuel additive and fuel formulations. These composition are effective in reducing intake valve deposits and do not contribute to increased combustion chamber deposits in port fuel injected engines. In particular, the present invention relates to novel fuel additives for use in gasoline formulations.

It is well known to those skilled in the art that internal combustion engines form deposits on the surface of engine components, such as carburetor ports, throttle bodies, fuel injectors, intake ports, and intake valves, due to the oxidation and polymerization of hydrocarbon fuel. Deposits also form in the combustion chamber of an internal combustion engine as a result of incomplete combustion of the mixture of air, fuel, and oil. These deposits, even when present in relatively minor amounts, often cause noticeable driving problems, such as stalling and poor acceleration. Moreover, engine deposits can significantly increase an automobile's fuel consumption and production of exhaust pollutants. Specifically, when the gasoline used in a given engine is of a constant octane number, the power output decreases when deposits are formed. In order to maintain the power output at a predetermined desired level, it then becomes necessary to increase the octane number of the fuel over the course of time. This Octane Requirement Increase (ORI) is undesirable. Therefore, the development of effective fuel detergents or deposit control additives to prevent or control such deposits is of considerable importance, and numerous attempts have been made to identify suitable compositions. The present invention is directed to novel compositions which have not only demonstrated unexpected and synergistic improvement in the control of intake valve deposits (IVD) compared to other formulations but also do not cause any significant increase in combustion chamber deposits.

U.S. Pat. No. 4,332,595, Herbstman et al., Jun. 1, 1982, discloses a compound having the formula $$R—[O—CH_2—CH(CH_3)]_y—NH—(CH_2)_3—NH_2$$

where R is hydrocarbyl radical having from 8 to 18 carbon atoms and y is about 2 to 6.

U.S. Pat. No. 5,089,029, Hashimoto et al., discloses a fuel additive composition which comprises an additive compound having the formula $$R—O—(AO)_m—(C_3H_6N)_nH$$

wherein R is a hydrocarbyl radical having 10 to 50 carbon atoms, A is an alkylene group having 2 to 6 carbon atoms, m is an integer of 10 to 50 and n is an integer of 1 to 3; and 0.05 to 20 parts by weight, per 1 part of said additive compound, of a mineral or synthetic oil. This patent also claims a fuel oil composition comprising a fuel oil, 1 to 20,000 ppm of the above additive compound, and 0.05 to 20 parts by weight, per 1 part of said additive compound, of a mineral or synthetic oil. The mineral or synthetic oil is preferably selected from the group consisting of poly-alpha-olefin, polybutene, an adduct of an alcohol with an alkylene oxide, an adduct of an alkylphenol with an alkylene oxide, an alkylene oxide polymer such as an addition product of propylene oxide or butylene oxide and an ester thereof.

U.S. Pat. No. 5,264,006, Schilowitz et al., Nov. 23, 1993, discloses distillate fuel compositions containing an alkyl ether monoamine having the formula $$RO[C_4H_8O]_{(9\text{-}18)}CH_2CH_2CH_2NH_2$$

where R is highly branched alkyl group derived from a Guerbet alcohol containing between 12 and 40 carbon atoms, are effective in reducing the formation of intake valve deposits in internal combustion engines.

SUMMARY OF THE INVENTION

It is the primary object of the present invention to provide a novel composition for use in fuels to substantially reduce IVD.

It is another object of the present invention to provide a novel composition for use in gasoline to substantially reduce IVD.

It is a further object of the present invention to provide a novel fuel additive for use in fuels to substantially reduce IVD and not contribute to increases in combustion chamber deposits in port fuel injected engines.

It is a still further object of the present invention to provide a novel fuel additive for use in gasoline to substantially reduce IVD and not contribute to increases in combustion chamber deposits in port fuel injected engines.

Additional objects and advantages of the present invention will be set forth in part in the description which follows and in part will be obvious from the description or may be learned by the practice of the invention. The objects and advantages of the invention may be realized and attained by means of the instrumentalities and combinations particularly pointed out in the appended claims.

To achieve the foregoing objects and in accordance with the purpose of the invention as embodied and broadly described herein, the fuel additive composition of the present invention comprises (A) at least one amine, said at least one amine having at least one polyolefin group and (B) at least one polyetheramine. These compositions are useful as fuel additives for reducing intake valve deposits. In addition, these compositions do not contribute to an increase in combustion chamber deposits in port fuel injected internal combustion engines.

In another aspect of the present invention, a concentrate and fuel compositions containing the foregoing fuel additive compositions is disclosed.

In still another aspect of the present invention, a method for reducing intake valve deposits in an internal combustion engine utilizing the fuel additive of the present invention is disclosed.

Reference will now be made in detail to the present preferred embodiments of the present invention.

DETAILED DESCRIPTION OF THE INVENTION

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

(2) substituted hydrocarbon substituents, that is, substituents containing non-hydrocarbon groups which, in the context of this invention, do not alter the predominantly hydrocarbon substituent (e.g., halo (especially chloro and fluoro), hydroxy, alkoxy, mercapto, alkylmercapto, nitro, nitroso, and sulfoxy);

(3) hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

The Fuel Additive

The fuel additive composition of the present invention comprises) at least one amine, wherein said at least one amine contains at least one polyolefin group; and at least one polyetheramine.

The amine (A)

The amine (A) comprises at least one polyolefin group. In a preferred embodiment of the present invention, the amine (A) is derived from an olefin polymer which may be prepared by a variety of methods. Typical methods for preparing Amine (A) comprise:

(1) reacting a halogenated olefin polymer with an amine, (See U.S. Pat. Nos. 3,275,554; 3,438,757; 3,454,555; 3,565,804; 3,755,433; and 3,822,289 herein incorporated by reference);

(2) reacting a hydroformylated olefin with a polyamine and hydrogenating the reaction product (See U.S. Pat. Nos. 5,567,845 and 5,496,383 herein incorporated by reference);

(3) converting a polyalkene by means of a conventional epoxidation reagent with or without a catalyst, into the corresponding epoxide and converting the epoxide into diaminoalkanes by reaction with ammonia or a polyamine under the conditions of reductive amination (See U.S. Pat. No. 5,350,429 herein incorporated by reference);

(4) reacting (a) polyolefin epoxide derived from a branched chain polyolefin with (b) ammonia and/or at least one amine to yield a hydroxyalkyl substituted amine (See PCT application WO 92/12221 herein incorporated by reference);

(5) epoxidizing an oligomeric olefin, converting the epoxidized oligomeric olefin to an alcohol and aminating the alcohol. (See U.S. Pat. No. 5,810,894 herein incorporated by reference);

(6) hydrogenation of a β-aminonitrile which is made by reacting an amine with a nitrile (See U.S. Pat. No. 5,492,641 herein incorporated by reference).

The above methods for the preparation of the amine are for illustrative purposes only and are not meant to be an exhaustive list. The amines of the present invention are not limited in scope to the methods of their preparation disclosed hereinabove.

The olefin polymers from which the amine (A) is derived include homopolymers and interpolymers of polymerizable olefin monomers of 2 to about 16 carbon atoms, preferably from 2 to about 6 carbon atoms, and especially preferred being from 2 to about 4 carbon atoms. The interpolymers are those in which two or more olefin monomers are interpolymerized according to well known conventional procedures to form polyalkenes having units within their structure derived from each of said two or more olefin monomers. Thus "interpolymer(s)" as used herein is inclusive of copolymers, terpolymers, and tetrapolymers. As will be apparent to those of ordinary skill in the art, the polyalkenes from which the polyalkene-substituted amines (A) are derived are often conventionally referred to as "polyolefin (s)".

The olefin monomers from which the olefin polymers are derived include polymerizable olefin monomers characterized by the presence of one or more ethylenically unsaturated groups (i.e., >C=C<); that is they are monoolefinic monomers such as ethylene, propylene, 1-butene, isobutene (2-methyl-1-butene), 1-octene or polyolefinic monomers (usually diolefinic monomers) such as 1,3-butadiene and isoprene.

The olefin monomers are usually polymerizable terminal olefins; that is, olefins characterized by the presence in their structure of the group $>C{=}CH_2$. However, polymerizable internal olefin monomers characterized by the presence within their structure of the group

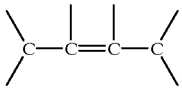

can also be used to form the polyalkenes.

Specific examples of terminal and internal olefin monomers which can be used to prepare the polyalkenes according to conventional, well-known polymerization techniques include ethylene; propylene; the butenes (butylenes), including 1-butene, 2-butene and isobutene; 1-pentene; 1-hexene; 1-heptene; 1-octene; 1-nonene; 1-decene; 2-pentene; propylene-tetramer; diisobutylene; isobutylene trimer; 1,2-butadiene; 1,3-butadiene; 1,2-pentadiene; 1,3-pentadiene; 1,4-pentadiene; isoprene; 1,5-hexadiene; 2-methyl-5-propyl-1-hexene; 3-pentene; 4-octene; and 3,3-dimethyl-1-pentene.

In another embodiment the olefin polymer is obtained by polymerization of a $C_4$ refinery stream having a butene content of about 35 to about 75 weight percent and isobutene content of about 30 to about 60 weight percent, in the presence of a Lewis acid catalyst such as aluminum trichloride or boron trifluoride. These polybutenes typically contain predominantly (greater than about 80% of total repeating units) isobutene repeating units of the configuration

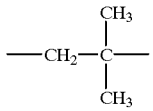

These polybutenes are typically monoolefinic, that is, they contain only one olefinic group per molecule, preferably said olefinic group is present as an end group.

In still another embodiment of the present invention, the monoolefinic end groups are vinylidene groups, i.e., groups of the formula

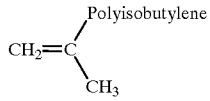

although the polybutenes may also comprise other olefinic configurations.

In a further preferred embodiment of the present invention, the polybutene comprises about at least 50%, more preferably at least 60% vinylidene end groups. Such materials and methods for preparing them are described in U.S. Pat. Nos. 5,286,823 and 5,408,018 herein incorporated by reference. These materials are commercially available under the tradenames Ultravis™ (BP Chemicals) and Glissopal™ (BASF).

In still another embodiment of the present invention, the amine (A) of this invention comprises at least one polyalkene-substituted amine where the polyalkene group is connected directed to the nitrogen atom of ammonia or an amine. The polyalkene substited amine may be synthesized from an olefin polymer (including functionalized olefin polymer) and ammonia and/or amine utilizing one of the methods previously described (e.g. reaction of a halogenated olefin polymer with ammonia and/or amine). The olefin polymer used to prepare such polyalkene substituted amine has also been described hereinabove.

The amines that can be used to prepare component (A) of this invention include ammonia, monoamines, polyamines, or mixtures of two or more thereof, including mixtures of different monoamines, mixtures of different polyamines, and mixtures of monomamines and polyamines (which include diamines). The amines include aliphatic, aromatic, heterocyclic and carbocyclic amines.

The monoamines and polyamines are characterized by the presence within their structure of at least one H—N< group. Therefore, they have at least one primary (i.e.,$H_2N$—) or secondary amine (i.e., 1H—N<) group. The amines can be aliphatic, cycloaliphatic, aromatic or heterocyclic.

The monoamines are generally substituted with a hydrocarbyl group having 1 to about 50 carbon atoms. Preferably these hydrocarbyl groups are aliphatic and free from acetylenic unsaturation and contain 1 to about 30 carbon atoms. Saturated aliphatic hydrocarbon radicals containing 1 to about 30 carbon atoms are particularly preferred.

In a still further embodiment of the present invention, the monoamines can be represented by the formula $HNR^1R^2$ wherein $R^1$ is a hydrocarbyl group of up to about 30 carbon atoms and $R^2$ is hydrogen or a hydrocarbyl group of up to about 30 carbon atoms. Examples of suitable monoamines include ethylamine, diethylamine, n-butylamine, di-n-butylamine, allylamine, isobutylamine, cocoamine, stearylamine, laurylamine, methyllaurylamine, and oleylamine.

Aromatic monoamines include those monoamines wherein a carbon atom of the aromatic ring structure is attached directly to the amine nitrogen. The aromatic ring will usually be a mononuclear aromatic ring (i.e., one derived from benzene) but can include fused aromatic rings, especially those derived from naphthalene. Examples of aromatic monoamines include aniline, di(para-methylphenyl)amine, naphthylamine, and N-(n-butyl) aniline. Examples of aliphatic substituted, cycloaliphatic-substituted, and heterocyclic-substituted aromatic monoamines include para-dodecylaniline, cyclohexyl-substituted naphthylamine, and thienyl-substituted aniline respectively.

Hydroxy amines are also included in the class of useful monoamines. Such compounds are the hydroxyhydrocarbyl-substituted analogs of the aforementioned monoamines. In a preferred embodiment of the present invention, the hydroxy monoamines can be represented by the formula $HNR^3R^4$, wherein $R^3$ is an alkyl or hydroxysubstituted alkyl radical of up to about 30 carbon atoms, more preferably up to about 10 carbon atoms, and $R^4$ is hydrogen or a hydrocarbyl group of up to about up 10 carbon atom. Suitable hydroxy-substituted monoamines include ethanolamine, di-3-propanolamine, 4-hydroxybutylamine, diethanolamine, and N-methyl-2-propylamine.

The amine can also be a polyamine. The polyamine may be aliphatic, cycloaliphatic, heterocyclic or aromatic. Examples of the polyamines include alkylene polyamines, hydroxy containing polyamines, arylpolyamines, and heterocyclic polyamines.

The alkylene polyamines include those represented by the formula

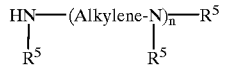

wherein n ranges from 1 to about 10, preferably from 2 to about 7, especially preferred being from 2 to about 5, and the "Alkylene" group has from 1 to about 10 carbon atoms, preferably from 2 to about 6, and especially preferred being from 2 to about 4 carbon atoms. $R^5$ is independently hydrogen, aliphatic, hydroxy- or amine-substituted aliphatic group of up to about 30 carbon atoms. Preferably $R^5$ is H or lower alkyl (an alkyl group of 1 to about 5 carbon atoms), most preferably, H. Such alkylene polyamines include methylene polyamine, ethylene polyamines, butylene polyamines, propylene polyamines, pentylene polyamines, hexylene polyamines and heptylene polyamines. The higher homologs of such amines and related aminoalkyl-substituted piperazines are also included.

Specific alkylene polyamines useful in preparing the polyalkene-substituted amines of this invention include ethylene diamine, diethylene triamine, triethylene tetramine, tetraethylene pentamine, propylene diamine, 3-dimethylaminopropylamine, trimethylene diamine, hexamethylene diamine, decamethylene diamine, octamethylene diamine, di(heptamethylene)triamine, tripropylene tetramine, pentaethylene hexamine, di(trimethylene triamine), N-(2-aminoethyl)piperazine, and 1,4-bis(2-aminoethyl)piperazine.

Ethylene polyamines, such as those mentioned above, are especially useful for reasons of cost and effectiveness. Such polyamines are described in detail under the heading "Diamines and Higher Amines" in the Encyclopedia of Chemical Technology, Second Edition, Kirk and Othemer, Volume 7, pages 27–39, Interscience Publishers, Division of John Wiley and Sons, 1965. Such compounds are prepared most conveniently by the reaction of an alkylene chloride with ammonia or by reaction of an ethylene imine with a ring-opening reagent such as ammonia. These reactions result in the production of the somewhat complex mixtures of alkylene polyamines, including cyclic condensation products such as piperazines.

Other useful types of polyamine mixtures are those resulting from stripping of the above-described polyamine mixtures to leave as residue what is often termed "polyamine bottoms". In general, alkylenepolyamine bottoms can be characterized as having less than two, usually less than 1% (by weight) material boiling below about 200° C. A typical sample of such ethylene polyamine bottoms obtained from the Dow Chemical Company of Freeport, Texas designated "E-100" has a specific gravity at 15.6° C. of 1.0168, a percent nitrogen by weight of 33.15 and a viscosity at 40° C. of 121 centistokes. Gas chromatography analysis of such a sample contains about 0.93% "Light Ends" (most probably DETA), 0.72% TETA, 21.74% tetraethylene pentamine and 76.61% pentaethylenehexamine and higher (by weight).

These alkylenepolyamine bottoms include cyclic condensation products such as piperazine and higher analogs of diethylenetriamine, triethylenetetramine and the like.

The hydroxy containing polyamines include hydroxyalkyl alkylene polyamines having one or more hydroxyalkyl substituents on the nitrogen atoms. Such polyamines may be made by reacting the above-described alkylenepolyamines with one or more of alkylene oxides (e.g., ethylene oxide, propylene oxide, and butylene oxide). Similar alkylene oxide-alkanolamine reaction products may also be used such as the products made by reacting primary, secondary or tertiary alkanolamines with ethylene, propylene or higher epoxides in a 1:1 to 1:2 molar ratio. Reactant ratios and temperatures for carrying out such reactions are known to those skilled in the art.

Preferred hydroxyalkyl-substituted alkylene polyamines are those in which the hydroxyalkyl group is a lower hydroxyalkyl group, i.e., having less than eight carbon atoms. Examples of such hydroxyalkyl substituted polyamines include N-(2-hydroxyethyl)ethylene diamine (also known as 2-(2-Aminoethylamino)ethanol), N,N-bis(2-hydroxyethyl)ethylene diamine, 1-(2-hydroxyethyl) piperazine, monohydroxypropyl-substituted diethylene triamine, dihydroxypropyl-substituted tetraethylene pentamine, and N-(3-hydroxybutyl)tetramethylene diamine.

The arylpolyamines are analogous to the aromatic monoamines mentioned above except for the presence within their structure of another amino nitrogen. Some example of arylpolyamines include N,N'-di-n-butyl-para-phenylene diamine and bis-(para-aminophenyl)methane.

The heterocyclic mono- and polyamines include aziridines, azetidines, azolidines, pyridines, pynoles, indoles, piperidines, imidazoles, piperazines, isoindoles, purines, morpholines, thiomorpholines, N-aminoalkylmorpholines, N-aminoalkylthiomorpholines, N-aminoalkylpiperazines, N,N'-diamino-alkylpiperazines, azepines, azocines, azonines, azecines and tetra-, di- and perhydro derivatives of each of the above and mixtures of two or more of these heterocyclic amines. Preferred heterocyclic amines are the saturated 5- and 6-membered heterocyclic amines containing only nitrogen, oxygen and/or sulfur in the hetero ring, especially the piperidines, piperazines, thiomorpholines, morpholines, pyrrolidines, and the like. Piperidine, aminoalkyl-substituted piperidines, piperazine, aminoalkyl-substituted piperazines, morpholine, aminoalkyl-substituted morpholines, pyrrolidine, and aminoalkyl-substituted pyrrolidines, are especially preferred. Usually the aminoalkyl substituents are substituted on a nitrogen atom forming part of the hetero ring. Specific examples of such heterocyclic amines include N-aminopropylmorpholine, N-aminoethylpiperazine, and N,N'-diaminoethylpiperazine. Hydroxy heterocyclic polyamines are also useful. Examples include N-(2-hydroxyethyl)cyclohexylamine, 3-hydroxy-cyclopentylamine, parahydroxy-aniline, and N-hydroxyethylpiperazine.

Examples of polyalkene substituted amines include poly (propylene)amines; poly(butene)amines such as N-poly (butene)ammonia; N-poly(butene)morpholine; N-poly (butene)ethylenediamine; N-poly(butene) trimethylenediamine; N-poly(butene)di-ethylenetriamine; N-poly(butene)tetraethylenepentamine; N,N-dimethyl-N'-poly(butene)-1,3-propylenediamine and 2-(2-poly(butene) aminoethylamino)ethanol. The number average molecular weight of the polyalkene substituted amines will typically range from about 500 to about 5000, preferably from about 1000 to about 1500.

The Polyetheramine (B)

The second component of the fuel additive composition of the present invention comprises at least one polyetheramine.

In one embodiment, the polyetheramine (B) is represented by the formula $$R^2[O(CH_2CH(R)O)_n—R^1—NH_2]_y \quad \text{(B-1)}$$

wherein in formula (B-1), n is a number from 1 to about 50; R independently is selected from the group consisting of hydrogen, hydrocarbyl groups of 1 to about 16 carbon atoms, and mixtures thereof; $R^1$ independently is selected from the group consisting of a hydrocarbylene group containing 2 to about 18 carbon atoms and a nitrogen containing group represented by the formula $$—(R^6NH)_p—R^7—$$

wherein both $R^6$ and $R^7$ are hydrocarbylene groups of about 2 to about 10 carbon atoms and p is a number from 1 to 4; y is 1, 2, or 3; and $R^2$ is a hydrocarbyl group containing (a) 1 to about 50 carbon atoms when y is 1 and (b) 1 to about 18 carbon atoms when y is 2 or 3.

The polyetheramines of formula (B-1) can include up to three primary amine functionalities (i.e., y in the above formula can have values of 1, 2, or 3), as well as compounds having a primary and secondary amine functionality in the same molecule.

The polyetheramines having one primary amino group include those where $R^1$ in formula (B-1) is a hydrocarbylene group, so that the polyetheramine is represented by the formula $$R^2O(CH_2CH(R)O)_nR^1NH_2 \quad \text{(B-2)}$$

wherein $R^2$ is a hydrocarbyl group having 1 to 50 carbon atoms; and n and R and $R^1$ are defined as above. Preferably, R is methyl, ethyl, or mixtures thereof. These correspond to the etheramine having propylene oxide (PO) or butylene oxide (BO) repeat units which are more soluble in gasoline than etheramines having ethylene oxide repeat units, although polyetheramines having mixtures of small amounts of ethylene oxide (EO) and higher alkylene oxide repeat units are also contemplated for use in the polyetheramines having one primary amine functionality. Illustrative of the above structural general formula (B-2) are polyetheramines represented by the formula $$R^2O(CH_2CH(R)O)_nCH_2CH(R)NH_2 \quad \text{(B-3)}$$

where n, R and $R^2$ are defined as in formula (B-2). These polyetheramine precursors are prepared by reaction of a monohydric alcohol initiator with an alkylene oxide (typically EO, PO, or BO). These precursors are then converted by reductive amination technology of the terminal hydroxyl group to the polyetheramine. Examples of these types of materials include the commercial JEFFAMINE™ M-Series of polyetheramines, manufactured by Huntsman Chemical Company. Among these JEFFAMINE™ M-600 and M-2005 are predominantly PO based having a mole ratio of PO/EO of approximately 9/1 and 32/3 respectively. These will typically have greater solubility in the hydrocarbon fuels than polyetheramines having higher concentration of EO units in the chain.

Examples of polyetheramines wherein $R^2$ is nonylphenyl include the SURFONAMINE™ series of surface active amines, manufactured by Huntsman Chemical Company. The series consist of amines with the general structure $$R^2—(OCH_2CH_2)_x—(OCH_2CH(CH_3))_y—NH2 \quad \text{(B-4)}$$

wherein in formula (B-4), $R^2$ is p-nonylphenyl, and the x/y ratio ranges from 1/2 to 12/2 as well as products containing only PO units.

Polyetheramines which are end capped with one or a few units of EO are also useful. Thus in one embodiment, the polyetheramine is represented by the formula $$R^2O(CH_2CH(CH_3)O)_{10\text{-}30}(CH_2CH_2O)_{1\text{-}5}CH_2CH_2NH_2 \quad \text{(B-5)}$$

wherein in formula (B-5), $R^2$ is a hydrocarbyl group of 10 to 20 carbon atoms.

Another useful class of polyetheramines are those represented by the formula $$R^2O(CH_2CH(R)O)_n[(CH_2)_3NH]_qH \quad \text{(B-6)}$$

wherein in formula (B-6), q is number from 1 to 5; and n, R and $R^2$ are defined as for formula (B-1) above. These polyetheramines can usually be prepared by cyanoethylating an adduct of an alcohol, or alkylphenol and an alkylene oxide with acrylonitrile and hydrogenating the obtained product, and, if necessary, followed by the repetition of the cyanoethylation and the hydrogenation steps. The cyanoethylation is typically conducted by stirring the reaction system under heating in the presence of a strong base catalyst such as caustic alkali. The hydrogenation can be conducted in the presence of a hydrogenation catalyst such as Raney nickel. In one embodiment, $R^2$ in formula (B-6) is an alkyl group of 12 to 15 carbon atoms, R is methyl and q is 1.

In another embodiment of the present invention the polyetheramine of formula (B-6) is represented more specifically by the formula $$R^2O(CH_2CH(R)O)_n(CH_2)_3NH_2 \quad \text{(B-7)}$$

wherein in formula (B-7), n is 1 to about 50; R is methyl; and $R^2$ is a hydrocarbyl group of about 10 to about 18 carbon atoms.

In a preferred embodiment of this aspect of the present invention, n in formula (B-7) is about 22 to about 27, and the polyetheramine is derived from a commercial polyether ("Actaclear™"; Lyondell Chemical Company) through the aforementioned cyanoethylation/hydrogenation steps.

Polyetheramines having two or three primary amine functionalities include the JEFFAMINE™ diamines and triamines respectively manufactured by Huntman Chemical Company. The JEFFAMINE™ diamines include the D-series represented by the structure $$H_2NCH(CH_3)CH_2—[OCH_2CH(CH_3)]_x—NH_2 \quad \text{(B-8)}$$

Wherein in formula (B-8), x ranges from 2 to 66, with molecular weights ranging from 230 to 4000. The JEFFAMINE™ triamines include the JEFFAMINE™ T-Series which are PO based triamines and are prepared by reaction of a PO with a triol initiator, followed by amination of the terminal hydroxyl groups. They are represented by the structure (B-9)

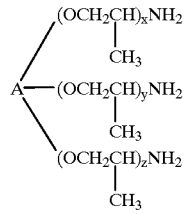

wherein in formula (B-9), A is a triol initiator and x, y, and z represent the number of repeat units of propylene oxide. The values of x, y, and z are such that the molecular weight of the triamine ranges from 440 to 5000. An example of a triol initiator is glycerol.

Other Optional Components

The fuel additive composition and fuel compositions of this invention may comprise in addition to components (A) and (B) certain other optional components.

In one embodiment, the fuel additive of this invention further comprises (C) a hydrocarbylphenol.

The hydrocarbylphenol of this invention can include a single aromatic nucleus, such as a benzene nucleus, as well as polynuclear aromatic moieties. Such polynuclear moieties can be of the fused type; that is wherein at least two aromatic nuclei are fused at two points to another nucleus such as found in naphthalene and anthracene. Specific examples of single and fused ring aromatic moieties can be found in U.S. Pat. No. 5,560,755 herein incorporated by reference. In one embodiment, the hydrocarbylphenol of this invention is represented by the formula (C-1)

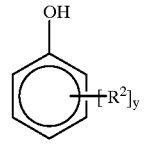

wherein in formula (C-1), $R^2$ is a hydrocarbyl group and y is 1 to 3; provided that if y is 1, $R_2$ has a molecular weight of about 500 to about 2500, preferably about 500 to about 1500 ; and if y is 2 or 3, then the total molecular weight of all $R^2$ groups is about 500–2500, preferably about 500 to about 1500.

Phenol compounds useful as starting materials for preparing the hydrocarbylphenol of formula (C-1) include mononuclear monohydroxy aromatic hydrocarbons. Specific compounds within these classes include phenol, xylenol, cresol, and other monohydric phenols. Corresponding compounds having low molecular weight alkyl radicals, such as $C_1$ to $C_4$-alkyl phenols, can also be used as the phenol component. The specific compound, phenol ($C_6H_5OH$) is the preferred hydroxy aromatic compound for the reaction.

The hydrocarbyl group(s) $R^2$ attached to the aromatic ring is derived from any natural or synthetic aliphatic hydrocarbon such that the total molecular weight of all $R^2$ is in the range of about 500 to 2500, preferably about 500 to about 1500. Thus, this material can be obtained from mineral oils or other natural hydrocarbons or organic materials. It can also be prepared synthetically. For example, polymers, copolymers or the corresponding hydrogenated polymers or copolymers obtained from the polymerization of olefinic hydrocarbons, such as $C_2$ to $C_6$ olefins, having the prescribed molecular weight are useful. Ethylene, propylene, 1,2-butylene, isobutylene and 2,3-butylene are particularly useful for preparing a suitable aliphatic hydrocarbon. The $R^2$ group attached to the substituted phenol will generally be saturated; however a small amount (typically less than 5 mole %) of olefinic unsaturation can be present without undesirable effects. A preferred source of the group $R^2$ is poly(isobutene)s obtained by polymerization of a $C_4$ refinery stream having a butene content of 35 to 75 weight percent and isobutene content of 30 to 60 weight percent, in the presence of a Lewis acid catalyst such as aluminum trichloride or boron trifluoride. These polybutenes typically contain predominantly (greater than 80% of total repeating units) isobutene repeating units of the configuration

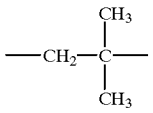

These polybutenes are typically monoolefinic, that is, they contain but one olefinic group per molecule said olefinic group being present as an end group.

In one embodiment, the monoolefinic end groups are vinylidene groups, i.e., groups of the formula

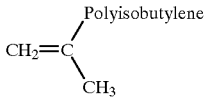

although the polybutenes may also comprise other olefinic configurations.

In still another embodiment of the present invention, the polybutene comprises at least about 60%, preferably at least about 80% vinylidene end groups. Such materials and methods for preparing them are described in U.S. Pat. Nos. 5,286,823 and 5,408,018. These types of materials are commercially available under the tradenames Ultravis™ (BP Chemicals) and Glissopal™ (BASF).

Numerous methods are known for preparing the hydrocarbyl substituted phenols described above and any of these are considered suitable for preparing the alkylphenol component of this invention. Techniques for alkylating phenols are well known to those skilled in the art. See, for example, the discussion in the article entitled "Alkylation of Phenols" in Kirk-Othmer "Encyclopedia of Chemical Technology", Second Edition, Vol. 1, pages 894–895, Interscience Publishers, a division of John Wiley and company, N.Y., 1963. One particularly suitable technique is the Friedel-crafts reaction, wherein an olefin (e.g., a polymer containing an olefinic bond, or halogenated or hydrohalogenated analog thereof), is reacted with a phenol. The reaction occurs in the presence of a Lewis acid catalyst (e.g., boron trifluoride and its complexes with ethers, phenols, hydrogen fluoride, etc., aluminum chloride, aluminum bromide, zinc dichloride, etc.). Other equally appropriate and convenient techniques for attaching the hydrocarbyl group $R^2$ in formula (C-1) to the aromatic ring will occur readily to those skilled in the art.

In a further aspect of the present invention, the fuel additive of this invention further comprises (D) an amide compound made by reacting a polyisobutene substituted lactone with an amine. The lactone typically is the result of reaction of an alkylphenol with a carboxylic acid. In a preferred embodiment, the alkylphenol is a polyisobutene substituted phenol wherein the molecular weight of the polyisobutene group ranges from about 500 to about 5000; the carboxylic acid is glyoxylic acid, and the amine is a polyamine, such as an alkylene polyamine. Examples of these amide products are disclosed in U.S. Pat. No. 5,336,278 herein incorporated by reference. In another embodiment of this aspect of the present invention olefin/glyoxylic lactones are described in copending U.S. Ser. Nos. 08/518,069, 09/057,850 and U.S. Pat. No. 5,696,067, each assigned to the assignee of the instant application and herein incorporated by reference may be utilized.

In a preferred embodiment of this aspect of the present invention, the polyisobutene substituted lactone used to prepare the amide compound (D) is represented by the formula (D-1)

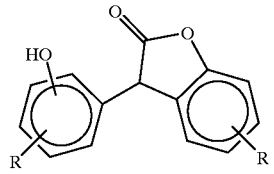

wherein in formula (D-1), R is a polyisobutene group having a number average molecular weight of about 500 to about 5000. The alkylene polyamine useful for preparing the amide (D) of this invention are the same as those described hereinabove for the preparation of the amine component (A) of this invention. In two preferred embodiments, the alkylene polyamines are diethethylene triamine and 3-dimethylaminopropylamine. In addition, amine reaction products of lactones prepared from polyisobutylene and glyoxylic acid-methyl ester/methyl hemiacetal as described in U.S. patent application Ser. No. 08/927,504, assigned to the assignee of the instant application and herein incorporated by reference may be utilized.

The Concentrate

The fuel additive compositions of this invention can be added directly to a fuel, or they can be diluted with a substantially inert, normally liquid organic diluent such as naphtha, benzene, toleue, xylene or a normally liquid fuel as described above, to form an additive concentrate. These concentrates generally contain from about 20% to about 90% by weight of the fuel additive of this invention and may contain, in addition one or more other conventional additives known in the art or described hereinbelow.

The Fuel Composition

The fuel composition of this invention comprises a major amount of a liquid fuel boiling in the gasoline boiling range and a minor amount of a fuel additive described hereinabove. The term "major portion" indicates that at least 60%, preferably at least 95% or more preferably at least 99% of the total fuel composition will comprise a liquid fuel boiling in the gasoline range.

The liquid fuel

The liquid fuels of this invention are well known to those skilled in the art and usually contain a major portion of a normally liquid fuel such as hydrocarbonaceous petroleum distillate fuel (e.g., motor gasoline as defined by ASTM Specifications D-439-89) and fuels containing non-hydrocarbonaceous materials such as alcohols, ethers, and organo-nitro compounds (e.g., methanol, ethanol, diethyl ether, methyl ethyl ether, nitromethane).

Oxygen containing molecules (oxygenates) are compounds covering a range of alcohol and ether type compounds. They have been recognized as means for increasing octane value of a base fuel. They have also been used as the sole fuel component, but more often as a supplemental fuel used together with, for example, gasoline, to form the well-known "gasohol" blend fuels. Oxygenated fuel (i.e. fuels containing oxygen-containing molecules) are described in ASTM D-4814-91. The oxygenated fuel of this invention will typically comprise up to about 25% by weight of one or more oxygen-containing molecules.

Methanol and ethanol are the most commonly used oxygen-containing molecules. Other oxygen-containing molecules, such as ethers, for example methyl-t-butyl ether, are more often used as octane number enhancers for gasoline.

Particularly preferred liquid fuels are gasoline, that is, a mixture of hydrocarbons having an ASTM boiling point of 60° C. at the 10% distillation point to about 205° C. at the 90% distillation point, oxygenates, and gasoline-oxygenate blends, all as defined in the aforementioned ASTM Specifications for automotive gasolines. Most preferred is gasoline.

Level of Fuel Additive

The motor fuel compositions of this invention contain an amount of fuel additive sufficient to provide total intake system cleanliness. They are also used in amounts sufficient to prevent or reduce the formation of intake valve or combustion chamber deposits or to remove them where they have formed. Treating levels of the additives used in this invention are often described in terms of parts per million (by weight) (ppm) or pounds per thousand balTels (ptb) of fuel. The ptb values may be multiplied by four to approximately convert the number to ppm. The amount of fuel additive of this invention (comprising components (A) and (B)) sufficient to provide total intake system cleanliness or to reduce the formation of intake valve or combustion chamber deposits is present at a level of about 10 to about 5000 parts per million (ppm), preferably about 50 to about 2000 ppm, and more preferably about 100 to about 500 ppm based on the weight of the liquid fuel.

Component (A) or (B) individually can be present in any concentration sufficient to provide total intake system cleanliness or to reduce the formation of intake valve or combustion chamber deposits. Typically, component (A) is present at a level of about 50 ppm to about 1000ppm based on the weight of the liquid fuel, preferably 75–750 ppm, especially preferred being 100–500 ppm. Typically, component (B) is present at a level of about 50 ppm to about 1000ppm based on the weight of the liquid fuel, preferably 75–750 ppm, especially preferred being 100–500 ppm.

The following examples set forth in Tables I and 2 below are set forth for illustrative purpose only.

EXAMPLES

Table 1 below discloses the results of intake valve deposit (IVD) clean-up results from a 3.3 L Chrysler engine. The test for the example in Table 1 comprises a 240 hour engine running test, the first 120 hours of engine running being with a base fuel containing a known commercial additive (e.g. polybutylamine) (Build-Up) followed by an additional 120 hour engine running with the base fuel including the additive of the present invention substituted for the commercial additive used during the first 120 hour test peliod (Clean-Up).

TABLE 1

Clean Up results from 3.3 L intake valve deposit test

| | Additive concentration (ptb) | | | | | % Clean-up[5] |
|---|---|---|---|---|---|---|
| Entry # | Amine[1] | Poly-ether fluid-izer[2] | Polyether-amine | PiB Phenol[6] | Total Polymer[4] | % Reduction of Deposit after Build-Up |
| 1 | 60 | 42 | — | — | 82 | 12 |
| 2 | 75 | 52.5 | — | — | 102 | 29 |
| 3 | 58 | 69.5 | — | — | 108 | 10 |
| 4 | — | — | 80[3] | — | 80 | 17 |
| 5 | 58 | — | 40.6[3] | — | 79 | 47 |
| 6 | 35 | — | 35[7] | 17.5 | 76 | 46 |

[1]N-poly(butene)ethylenediamine; Mn ~ 1300; ~66% active polymers
[2]Alcohol initiated polyoxypropylene monool
[3]Made from sequential cyanoethylation/hydrogenation of the alcohol of footnote 2
[4]Concentration of total nonvolatile active polymers
[5]The percent Clean Up equals IVD after Build-Up-IVD after Clean-Up × % IVD after Build-Up
[6]Polyisobutene phenol molecular weight equals 1000
[7]Made by reductive amination of a 4-alkylphenol initiated polyoxypropylene monool Table 2 discloses the results from a Ford 2.3L keep clean test using the additives of Table 1. The procedure for the keep clean test is ASTM D-6201.

TABLE 2

Ford 2.3 L keep clean results

| | Additive concentration (ptb) | | | | |
|---|---|---|---|---|---|
| Entry # | Amine* | Polyether fluidizer | Polyetheramine* | Total Polymer | Keep Clean mg |
| 1 | 75 | 52.5 | — | 102 | 236 |
| 2 | — | — | 90 | 90 | 107 |
| 3 | 46.6 | — | 32.6 | 63.4 | 258 |
| 4 | 54 | — | 37.8 | 73.4 | 83 |
| 5 | 58 | — | 40.6 | 78.9 | 75 |

*The amine, polyether fluidizer, and polyetheramine (identified in Footnote 3 of Table 1) are the same as utilized in Table 1

Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil which may be customarily present in the commercial material, unless otherwise indicated. It is to be understood that the upper and lower amount, range, and ratio limits set forth herein may be independently combined.

What is claimed is:

1. A composition comprising (A) at least one amine, said at least one amine having at least one polyolefin group and (B) at least one polyetheramine.

2. The composition of claim 1 wherein component (A) is derived from an olefin polymer.

3. The composition of claim 2 wherein the olefin polymer comprises olefinic end groups.

4. The composition of claim 3 wherein at least 60% of the olefin end groups are of vinylidene structure.

5. The composition of claim 1 wherein component (A) is derived from reacting a halogenated olefin polymer with ammonia and/or at least one amine.

6. The composition of claim 5 wherein the olefin polymer is derived from polymerizing at least one olefin monomer of 2 to about 16 carbon atoms.

7. The composition of claim 6 wherein the olefin monomer is selected from the group consisting of ethylene, a propylene, a butene, and mixtures of at least two thereof.

8. The composition of claim 6 wherein the olefin monomer is isobutene.

9. The composition of claim 1 wherein component (A) comprises a poly(butene)amine.

10. The composition of claim 9 wherein number average molecular weight of the poly(butene)amine ranges from about 500 to about 5000.

11. The composition of claim 9 wherein the poly(butene) amine is selected from the group consisting of N-poly (butene)amine, N-poly(butene)ethylenediamine, N-poly (butene)diethylenetriamine, N,N-dimethyl-N'poly(butene)-1,3-propylenediamine and 2-(2-poly(butene) aminoethylamino)ethanol.

12. The composition of claim 1 wherein component (A) is a hydroxyalkyl substituted amine made by reacting:

(a) a polyolefin epoxide derived from a branched chain polyolefin; with (b) ammonia and/or at least one amine.

13. The composition of claim 1 wherein component (A) is made by a process comprising the steps of:

A) epoxidizing an oligomeric olefin;

B) converting the epoxidized oligomeric olefin to an alcohol; and

C) aminating the alcohol of step B).

14. The composition of claim 1 wherein component (B) is represented by the formula $$R^2[O(CH_2CH(R)O)_n—R^1—NH_2]_y \quad \text{(B-1)}$$

wherein in formula (B-1), each n is a number from 1 to about 50; each R independently is selected from the group consisting of hydrogen, hydrocarbyl groups of 1 to about 16 carbon atoms, and mixtures thereof; each $R^1$ independently is selected from the group consisting of a hydrocarbylene group containing 2 to about 18 carbon atoms and a nitrogen containing group represented by the formula $$—(R^6NH)_p—R^7—$$

wherein both $R^6$ and $R^7$ are hydrocarbylene groups of about 2 to about 10 carbon atoms and p is a number from 1 to 4; y is 1, 2, or 3; and R2 is a hydrocarbyl group having a valence of y and containing 1 to about 50 carbon atoms when y is 1 and 1 to about 18 carbon atoms when y is 2 or 3.

15. The composition of claim 14 wherein component (B) is represented by the formula $$R^2O(CH_2CH(R)O)_n[(CH_2)_3NH]_qH \quad \text{(B-6)}$$

wherein in formula (B-6), q is number from 1 to 5.

16. The composition of claim 15 wherein q is 1, $R^2$ is a linear alkyl group of about 10 to about 20 carbon atoms, R is a hydrocarbyl group of 1 to 3 carbon atoms, and n is a number from about 20 to about 30.

17. The composition of claim 14 wherein component (B) is represented by the formula $$R^2O(CH_2CH(R)O)_nCH_2CH(R)NH_2 \quad \text{(B-3)}$$

wherein R is independently selected from the group consisting of methyl and ethyl, and $R^2$ is a hydrocarbyl group having 10–20 carbon atoms.

18. The composition of claim 1 further comprising (C) at least one hydrocarbylphenol.

19. The composition of claim 18 wherein the hydrocarbylphenol is represented by the formula (C-1)

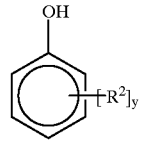

wherein in formula (C-1), $R^2$ is a hydrocarbyl group; and y is 1 to 3; provided that if y is 1, $R^2$ has a molecular weight of about 500 to about 2500; and if y is 2 or 3, then the total molecular weight of all $R^2$ groups is about 500 to about 2500.

20. The composition of claim 19 wherein y is 1 and $R^2$ is a polyisobutene group.

21. The composition of claim 19 wherein $R^2$ is derived from a polyisobutene having olefin end groups.

22. The composition of claim 21 wherein at least 60% of the olefin end groups are of vinylidene structure.

23. The composition of claim 1 further comprising (D) at least one amide compound made by reacting a polyisobutene substituted lactone with an amine.

24. The composition of claim 23 wherein the lactone is represented by the structure (D-1)

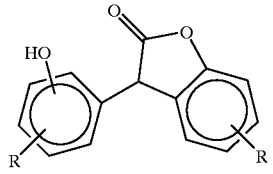

wherein in formula (D-1), R is a polyisobutene group having a number average molecular weight of about 500 to about 5000.

25. The composition of claim 23 wherein the amine is an alkylene polyamine.

26. The composition of claim 23 wherein the amine is diethylene triamine.

27. The composition of claim 23 wherein the amine is 3-dimethylaminopropylamine.

28. A concentrate comprising about 10% to about 90% by weight of an organic diluent and the composition of claim 1.

29. A fuel composition comprising a major amount of a liquid fuel in the gasoline boiling range and a minor amount of an additive composition comprising at least two components:

A) at least one hydrocarbyl substituted amine, the hydrocarbyl substituent of said amine comprising at least one polyolefin group; and B) at least one polyetheramine.

30. The fuel composition of claim 29 wherein the additive composition is present at a level of about 10 to about 5000 parts per million based on the weight of the hydrocarbon in the gasoline boiling range.

31. A fuel composition comprising a major amount of a liquid fuel in the gasoline boiling range and a minor amount of an additive composition comprising at least two components:

A) a poly(isobutylene)amine having a number average molecular weight ranging from about 500 to about 5000; and B) a polyetheramine represented by the formula $$R^2O(CH_2CH(R)O)_n[(CH_2)_3NH]_qH \quad \text{(B-6)}$$

wherein in formula (B-6), q is number from 1 to 5, $R^2$ is a hydrocarbyl group of about 1 to about 50 carbon atoms; R is a hydrocarbyl group of 1 to about 16 carbon atoms; and n is number from 1 to about 50.

32. A method for reducing the intake valve or combustion chamber deposits in an internal combustion engine, comprising fueling said engine with the fuel composition of claim 29.

33. A fuel additive composition prepared by mixing at least one amine and at least one polyetheramine wherein the at least one amine contains at least one polyolefin group.

* * * * *